United States Patent [19]

Dunn, Jr.

[11] 3,973,908

[45] Aug. 10, 1976

[54] METHOD FOR DYEING FROM SOLVENTS

[75] Inventor: James L. Dunn, Jr., Lake Jackson, Tex.

[73] Assignee: The Dow Chemical Company, Midland, Mich.

[22] Filed: Aug. 14, 1972

[21] Appl. No.: 280,568

[52] U.S. Cl. ..... 8/176; 8/174; 8/175; 8/158; 8/94 A

[51] Int. Cl.[2] ..... D06P 5/00

[58] Field of Search ..... 8/94, 174, 158, 176

[56] References Cited

UNITED STATES PATENTS

| | | | |
|---|---|---|---|
| 2,828,180 | 3/1958 | Lertorio | 8/62 |
| 3,473,175 | 10/1969 | Lober | 8/158 |
| 3,523,749 | 8/1970 | MacLeod et al. | 8/163 |
| 3,667,898 | 6/1972 | Bergman et al. | 8/94 |
| 3,692,467 | 9/1972 | Durr et al. | 8/158 |
| 3,706,525 | 12/1972 | Blackwell et al. | 8/173 |
| 3,708,260 | 1/1973 | Marshall | 8/109 |
| 3,765,840 | 10/1973 | Durr et al. | 8/158 X |

OTHER PUBLICATIONS

Milicevic, "Solvent Dyeing; Theory & Practice" *Textile Chemist & Colorist*, vol. 2, No. 5, (1970 pp. 87–98).

White, American Dyestuff Rep. July 31, 1967 pp. 591–597.

*Primary Examiner*—Donald Levy

*Attorney, Agent, or Firm*—Glwynn R. Baker

[57] ABSTRACT

A method for dyeing polyester fibers by contacting the fiber, which may be in the form of loose fibers or staple, filament or texturized yarn, woven or knitted fabric, with a solution of a soluble dyestuff in a suitable solvent, such as a chlorinated solvent, reducing the volume of the solute in contact with the fiber while maintaining the volume of liquid in contact with the fiber substantially constant by addition of a nonsolvent, maintaining the temperature of the fiber and contacting solvent-nonsolvent at a temperature to effect dyeing. The process also includes the procedures for purifying the solvent and nonsolvent to enable their reuse (recycling) in the process economically and reducing the waste material from the process.

The process also provides for scouring and/or drying the fiber if such be necessary.

8 Claims, 1 Drawing Figure

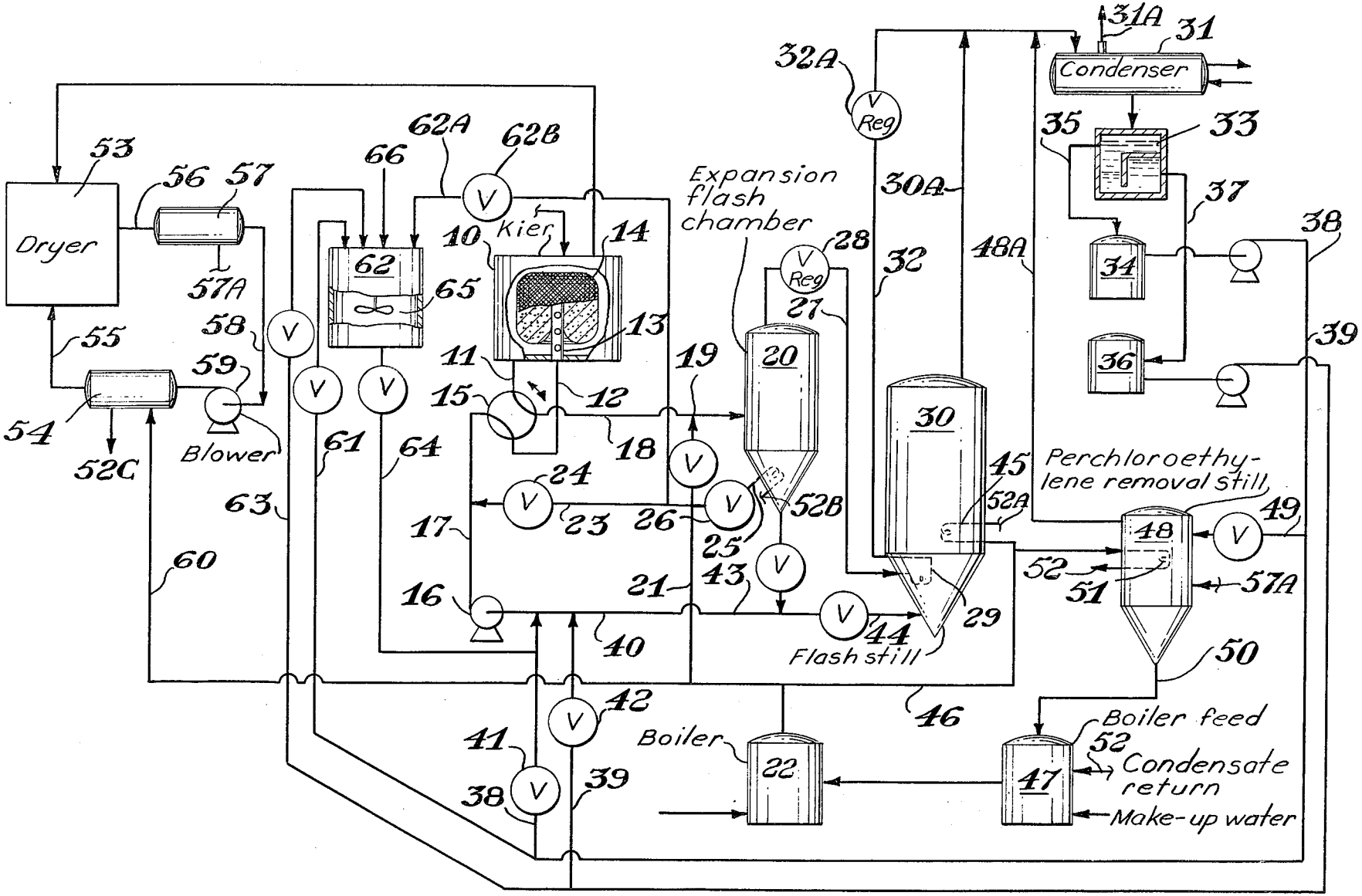
Condenser
Perchloroethylene removal still
Boiler feed
Condensate return
Make-up water
Flash still
Expansion flash chamber
Boiler
Kier
Blower
Dryer
Reg

METHOD FOR DYEING FROM SOLVENTS

BACKGROUND OF THE INVENTION

Solvent dyeing of textile fibers and fabrics has become increasingly important in the industry's efforts to reduce waste discharged to our environment as well as increase productivity of the dyeing process. The more successful approaches to utilization of solvents to replace water in the dyeing processes suffer from the physico-chemical property differences between solvents and water, as, for example, high solubility of dyestuffs in the solvent resulting in poor dye yields, low distribution coefficients of solvent-soluble dyestuffs with fibers resulting in a poor distribution of dyestuff between the fiber and the solvent. These two properties alone make solvent dyeing unattractive for large volume uses.

Further, conventional aqueous dyeing techniques generate large quantities of waste material which previously had been dumped into streams creating ecological problems.

It therefore would be advantageous to have a process which could dye fibers, particularly polyester fibers, employing solvents which, in spite of the physico-chemical properties of the solvent-dye system, can obtain a substantial exhaustion of the dyestuff from the solvent.

The invention described herein permits the recycle of all of the fluids of solvent and water because less chemical additives are used than in the conventional dispersed dye system for polyester fibers. Additionally, the use of the solvent, with its inherent low latent heat of vaporization, permits distillation at locations where fuel costs are economical. The present invention also reduces the amount of fluids necessary for dyeing, thus permitting the use of means such as distillation, carbon adsorption, reverse osmosis, biodegradation, flocculation, filtration or combinations thereof as needed to purify and recycle substantially all of the fluids.

BRIEF DESCRIPTION OF THE INVENTION

In accordance with the present invention, polyester fiber can be dyed from a solvent, such as a chlorinated solvent, using dyestuffs soluble in the solvent with or without the aid of cosolvents by contacting the fiber with a volume of a solution of the dyestuff sufficient to carry the required amount of dyestuff to dye the fiber to the shade desired. The volume of solution of dyestuff and solvent, if insufficient to fill the dye system, is augmented with enough nonsolvent, e.g., water, to supply that volume. The fiber is contacted with the dyebath at a temperature to dye the fiber. Solvent content of the dyebath is reduced during the contacting step by distillation of the solvent while maintaining a substantially constant volume of liquid in the system by replacing the solvent removed with a nonsolvent, e.g., water. The dyeing step is completed when substantially all of the solvent has been removed from the system and the temperature of the fibers and liquid is such that the dyestuff will diffuse into the fiber. The liquid remaining in the system is drained, preferably while hot, and the fiber scoured with solvent or in a conventional manner and dried as necessary. The process is operated under a pressure to obtain the necessary dyeing temperature and the solvent is distilled from the dyebath by flash evaporation of an azeotrope of the solvent and nonsolvent from the dyebath. One convenient method for accomplishing this is to supply the nonsolvent as water in the form of liquid and steam to maintain a constant liquid volume. In this method, the steam upon contacting the liquid supplies the heat of evaporation of the solvent, viz., an azeotrope of solvent-nonsolvent, to the system as well as part of the make-up nonsolvent, e.g., water. This gaseous azeotrope mixture is then used under pressure in a heat exchanger to distill water from a previous cycle to purify it for a future cycle. Another method for supplying the heat of vaporization of the liquid is to employ an external source of heat through a heat exchanger.

Finally, the fiber is dried and/or scoured if necessary with solvent which is recovered from the scouring step by either steam distillation or a confined drying process.

Other means for purification of the solvent and nonsolvent may also be employed, as for example, adsorptive processes, reverse osmosis, flocculation, filtration or a combination of these various means.

DETAILED DESCRIPTION OF THE INVENTION

The following detailed description of the process of the present invention has particular reference to the drawings.

The drawing illustrates a schematic diagram of a batch dye process such as employed to kier-dye yarns. A kier 10 is provided with external piping 11 and 12 which permit introduction of liquid into and out of the kier 10. For sake of clarity, piping 12 is illustrated as connecting with the multi-holed mandrel 13 interior of kier 10 and upon which the yarn packages 14 are positioned in the kier 10. A valve 15 is positioned in piping 11 and 12 to enable fluid to be directed into piping 11 and into the kier 10 through the mandrel 13 and withdrawn from the interior of kier 10 through piping 12 or to be introduced through piping 12 into the interior of kier 10 and withdrawn through mandrel 13 into piping 12. Connected to valve 15 is a pump 16 and its associated piping 17 and leading away from the valve 15 is piping 18 provided with a steam mixing section 19 prior to its termination in expansion flash chamber 20. Expansion flash chamber 20 is connected from its lower extent to the intake of pump 16. Mixing section 19 is provided with a steam line 21 from a boiler 22. A separate line 23 from steam line 21 connects to the piping 17 and is provided with a valve 24 which controls the admission of steam into the kier 10 if and when there is a desire to contact packages 14 with direct steam. Another separate line 25 extends from steam line 21 into the lower portion of the expansion flash chamber 20 to provide auxiliary heat to the expansion flash chamber 20 as required. This line 25 is valved at 26. The top of expansion flash chamber 20 is connected through piping 27 and pressure regulator 28 into heat exchanger 29 in a still 30. The heat exchanger 29 is connected on its outlet side to a condenser 31 through piping 32 and pressure regulator **32*a*. Thus, expansion flash chamber 20 is connected through piping 27 and its pressure regulator 28 to heat exchanger 29 in still 30, directing vapors from expansion flash chamber 20 into heat exchanger 29 of still 30. The pressure regulator 28 effectively controls the temperature of the vapors leaving flash chamber 20 in a manner to provide the requisite or a part of the requisite BTU's necessary to vaporize the water in still 30. The vapors and any condensate in heat exchanger 29 are directed to the condenser 31 through piping 32 and pressure regulator 32*a*. The vapors generated in still 30 are directed to condenser 31 through line 30***a*. Condenser 31 has an atmospheric vent 31*a*. The condensate from condenser 31 is directed to a water separator 33 and the water separated in separator 33 is directed to clean water storage 34 through piping 35. The solvent separated in separator 33 is directed to clean solvent storage 36 through piping 37. Both storage reservoirs 34 and 36 are connected with piping 38 and 39, respectively, to a line 40 to provide fluid to the pump 16 when required. Pipe 38 is provided with valve 41 and line 39 is provided with valve 42 to control the flow of fluid from the respective storages.

Still 20 and kier 10 are joined with pipe 43 to transfer liquid to flash still 30 by manipulation of valve 44 in pipe 43. Still 30 is further provided with a second heat exchanger 45 connected to the boiler 22 by line 46.

A solvent removal still 48 is connected to the clean water storage 34 through line 49, the solvent vapors going overhead through line 48A to condenser 31 and the water being taken off the bottom through line 50 to the boiler feed 47. A heat exchanger 51 located in still 48 is connected to the boiler feed 47 with condensate being returned to the boiler feed 47 through line 52. In a similar fashion, condensate is returned to line 52 from heat exchanger 45 with line 52A and heat exchanger 25 with line 52B.

A dryer section is provided with a drying chamber 53 for receiving wet yarn from kier 10. The dryer 53 is illustrated as a hot moist air-recycle dryer. The air is heated in exchanger 54 and delivered to chamber 53 through ducting 55. The air with its associated water and/or solvent vapor is withdrawn from chamber 53 through ducting 56 and passed through a condenser 57. The dehumidified air is drawn from the condenser 57 through ducting 58 by fan 59 and delivered to the heat exchanger 54. Steam is provided to heater 54 through piping 60 from boiler 22 and the condensate 52C from the exchanger 54 is returned to the boiler feed 47 through to line 52. Condensate 57A removed from the air in condenser 57 is delivered to the solvent recovery still 48 wherein any solvent is sent to condenser 31 and any water is sent to the boiler feed 47.

Dye preparation tank 62 is provided with piping 63 and 61 to both the clean solvent 36 and clean water 34 storages and an outlet through piping 64 to the kier 10 through pump 16. Tank 62 is provided with stirring means 65. Dye in either liquid, paste or powder form is added to tank 62 by pipe 66. Steam line 62A and associated valve 62B is provided to heat dye tank 62 as needed.

Having described the equipment and its piping and auxiliaries, the operation of such equipment in accordance with the process of the present invention will be described:

The kier 10 was loaded with a yarn package, weighing about 500 grams, of 150/35 polyester yarn and the kier 10 closed. A dyestuff, for example, 10 grams of Resolin Brilliant Yellow 7GL (CI disperse Yellow 93) obtained free of dispersing agent as a press-cake from the manufacturer was dissolved in 500 ml. of perchloroethylene to produce a dye solution based on the weight of fiber (owf) to be dyed at a level of 2% owf. The total liquid volume was made up to about 1½ gallons in dye tank 62 by adding water with stirring to produce a two-phase system. This liquid was pumped into kier 10 which was vented until the kier was full and substantially free of air. The two-phase liquid system (water and perchloroethylene-dye mixture) was maintained, admixed by stirring and circulation through the piping and kier 10 with pump 16. The pump 16 continued to draw liquid from the dye preparation 62 tank until the equipment (kier 10, pump 16, expansion chamber 20 and associated piping) was full and a level of liquid was maintained in the lower portion of the expansion flash chamber 20. Withdrawal of liquid from the dye preparation tank 62 was stopped and steam admitted to mixing section 19. The pump 16 continued to circulate liquid through the dye equipment. As the liquid was heated, pressure began to build up in the system as the temperature approached the water-perchloroethylene azeotrope boiling point under the back-pressure established by pressure regulator 28. As the temperature of the liquid in the system increased, the azeotrope vapors passed through the pressure regulator 28, thus removing the solvent from the system as a water-solvent azeotrope. The pressure at which the azeotrope will escape the system is set to maintain the liquid in the system at the dyeing temperature, in this example, 130°C. When the solvent had been substantially removed from the system, the kier 10 was drained to the still 30 while hot, followed by reducing the pressure to atmospheric pressure and the yarn removed. The yarn was wet with water and contained about 0.2 weight percent perchloroethylene retained in the fiber. The yarn was dried in an oven at 105°C.

The dried yarn was knit into a sleeve. Portions of this sleeve were used to conduct various tests. About ⅓ of the sleeve was conventional scoured, ⅓ solvent scoured, while the remainder was unscoured. The conventional scouring used a scouring liquid containing 1 g./l. of sodium hydrosulfite and 1 g./l. of caustic soda was charged to the kier and circulated for 20 minutes at 180°F. (ca. 82.5°C.), drained, and followed by a water rinse containing 1% acetic acid at 180°F. for 10 minutes.

Solvent scouring was carried out by stirring 20 grams of the dry dyed knit stocking in 400 milliliters of perchloroethylene for 10 minutes, followed by air drying before testing. Three temperatures were employed to scour three 20-gram portions of each dyed knit stocking; 50°, 60° and 70°C. The results obtained indicate that solvent scouring is time-temperature related. At 50° and 60°C., about equivalent results were obtained, but at 70°C. for 10 minutes, some loss in wash fastness was observed. Therefore, the data reported is that for 50°C. for 10 minutes since this is nearest to, although above, the temperature one employs in commercial dry cleaning processes. It is expected that higher temperatures will necessitate shorter periods of contact with the solvent.

Each scouring was followed by drying. Portions of each sleeve scoured by each technique were then subjected to Light Fastness Test AATCC 16A-1964, Wash Fastness Test AATCC 61-1962, Dry Cleaning Test AATCC 85-1960T, Crocking Fastness Test AATCC 8-1961, tensile strength and percent elongation of the yarn was tested on an Instron machine, reflectometer readings, as well as analysis of yarn dye bath and scour liquors for dye exhaustion and overall material balance.

In order to obtain a comparison of the present process with a conventional dye technique using a disperse dye, water and conventional dye assistants, another package of the same yarn was dyed according to the following conventional dye process:

A pressure kier was charged with one yarn package (approximately 500 grams yarn) of 150/35 polyester yarn and filled with a bath containing 1% by weight Basol WS, a surfactant, 1% acetic acid, 4% Tanavol, a dye carrier and ¼% of the sodium salt of ethylenediamine tetraacetic acid in water. The bath was pumped through the system and heated to 120°F. (ca. 49°C.) and upon reaching 120°F. was maintained thereat for 10 minutes. A predispersed dye, CI Disperse Yellow 93 (as manufactured containing dispersants) was added to the bath in an amount to give 2% dye owf. Actual active dyestuff in this commercial product is about 25% of the total weight of the manufactured dyestuff. The bath was pumped with heating to maintain the temperature at 120°F. for 10 minutes. Following this period, the bath was heated to 180°F. at a rate of 3°F./min.; this step took 20 minutes. The kier was sealed and the temperature of the bath raised to 265°F. at a rate of 3°F./min.; this step took 28 minutes. The bath was continuously circulated through the kier during this period. The kier temperature was maintained at 265°F. (ca. 130°C.) for 45 minutes. The bath was then permitted to cool to 200°F. (ca. 93°C.) while circulating the bath through the kier. Upon reaching 200°F., the waste dye solution was drained from the kier and cool water was admitted with circulation to rinse the package and kier free of dye solution and the rinse water drained. The yarn was dried in an oven at 105°C. The dried yarn was knit into a sleeve which was subjected to the same tests as the yarn dyed in accordance with the present invention.

The results of these tests on the various yarns are set forth below:

| | Conventional Disperse Dyeing Unscoured | Unscoured | Present Invention Conv. Scoured | Solvent Scoured*** |
|---|---|---|---|---|
| Light Fastness (AATCC 16A-1964) | 12-15 hours | 20 | 20 hrs. | — |
| Wash Fastness, Shade Change | 5 | 5 | 5 | 5 |
| (AATCC 62-1969) Staining AN** | 3 | 4 | 4 | 4+ |
| Staining WSV** | 5 | 5 | 5 | |
| Dry Cleaning, Shade Change | 5 | 5 | 5 | 5 |
| (AATCC 85-1960T Staining | 4 + NV** | 5ANWSVC** | 4 + AN** | 5AN** |
| Staining | 5 AWSC** | — | 5WSVC** | 5WSVC** |
| Crocking, Dry | 4 | 4 | 4+ | 5 |
| (AATC 8-1969), Wet | 4+ | 4+ | 5 | 5 |
| Tensile Instron | 666 grams | 636 | — | — |
| Elongation Instron | 31.5% | 28.6 | — | — |
| Color reading (sepectrophotometer) | 2.30 | 2.50 | — | — |
| 2% owf. ≡ 10 g./l. | | | | |
| Dye fixed | 6.45 g. | 6.51 g. | — | — |
| Dye unfixed | 0.23 | 0.17 | — | — |
| Unexhausted | 0.32 | 0.06 | — | — |
| Dye lost | 3.0 | 3.26 | — | — |

*Scale 1 to 5; 1-poorest, 5-best
**A = acetate; N = nylon; W = wool; S = silk; V = viscose; C = cotton
***50°C. perchloroethylene contacted for ten minutes Although this example used yarn wound in package form, fibers in the form of staple, filament, woven or knitted fabric are considered to be suitable to dye in a similar fashion when using the proper machinery for handling the desired form of fiber.

This method used perchloroethylene as the preferred solute for the dye but other solvents such as the chlorinated hydrocarbon solvents, e.g., 1,1,1-trichloroethane, methylene chloride; the fluorocarbons, e.g., 1,1,2,2-tetrachloro - 1,2-difluoroethane (F112), 1,1,2-trichloro - 1,2,2-trifluoroethane (F113), may be considered as suitable solutes depending on dye or fiber selected.

I claim:

1. A method for dyeing polyester fiber which comprises:

1. preparing a volume of perchloroethylene solution containing the required amount of solvent soluble dyestuff dissolved therein to give the desired shade;
2. adjusting the volume of the perchloroethylene-dye solution to a volume sufficient to fill the dyeing equipment, auxiliary piping and an associated expansion flash chamber by adding water to said perchloroethylene-dye solution to prepare a two-phase liquid system;
3. contacting the adjusted two-phase liquid system with said fiber; while:
   a. raising the temperature of said two-phase system to a temperature sufficient to dye the fiber;
   b. maintaining a superatmospheric pressure on said system sufficient to maintain the liquids thereof substantially in the liquid state;
   c. circulating the two-phase system through the dyeing equipment and the expansion flash chamber communicating therewith;
   d. reducing the volume of solvent in said system by distilling the solvent from the system by releasing the pressure thereon in said flash chamber to vaporize said solvent and a portion of said water if it azeotropes with said solvent;
   e. recycling the water and any solvent which does not flash off to the dyeing equipment;
   f. continuing said circulation and said volume reduction while maintaining the volume of said system substantially constant by adding steam from a source external of the circulating water to the system; and
   g. continuing said reduction of said solvent until the system is substantially free of solvent.

2. The method of claim 1 wherein the following additional steps are carried out: draining the liquid from said system, reducing the pressure to atmospheric pressure, and removing the dyed fiber, knitting the dyed fiber and solvent scouring the so-knit fiber.

3. The method in claim 1 wherein the gaseous azeotrope mixture of solvent and water is used in a heat exchanger to distill and thus purify the waste water drained from a previous dyeing cycle.

4. The method of claim 1 wherein the solvent is perchloroethylene.

5. The method of claim 1 wherein the solvent is 1,1,1-trichloroethane.

6. The method of claim 1 wherein the solvent is methylene chloride.

7. A method for dyeing textile fibers which comprises:

1. preparing a volume of an organic halogenated hydrocarbon solvent selected from the group consisting of perchloroethylene, 1,1,1-trichloroethane, methylene chloride, 1,1,2,2-tetrachloro-1,2-difluoro ethane and 1,1,2-trichloro-1,2,2-trifluoro ethane containing the required amount of solvent soluble dyestuff dissolved therein to give the desired shade;
2. adjusting the volume of the solvent-dyestuff solution to a volume sufficient to fill the dyeing equipment auxiliary piping and an associated expansion flash chamber by adding to said solvent-dyestuff solution water to prepare a two-phase liquid system;
3. contacting the adjusted two-phase system with said fiber; while;
   a. raising the temperature of said two-phase system to a temperature sufficient to dye the fiber;
   b. maintaining a superatmospheric pressure on said system sufficient to maintain the liquids thereof substantially in the liquid state;
   c. circulating the two-phase system through the dyeing equipment and the expansion flash chamber communicating therewith;
   d. reducing the volume of solvent in said system by distilling the solvent from the system by releasing the pressure thereon in said flash chamber to vaporize said solvent and a portion of said water if it azeotropes with said solvent;
   e. recycling the water and any solvent which does not flash off to the dyeing equipment;
   f. continuing said circulation and said volume reduction while maintaining the volume of said system substantially constant by adding steam from a source external of the circulating water to the system; and
4. continuing said reduction of said solvent until the system is substantially free of solvent.

8. A method for dyeing textile fibers which comprises:

1. preparing a volume of an organic chlorinated hydrocarbon solvent selected from the group consisting of perchloroethylene, 1,1,1-trichloroethane and methylene chloride containing the required amount of solvent soluble dyestuff dissolved therein to give the desired shade;
2. adjusting the volume of the solvent-dyestuff solution to a volume sufficient to fill the dyeing equipment auxiliary piping and an associated expansion flash chamber by adding to said solvent-dyestuff solution water to prepare a two-phase liquid system;
3. contacting the adjusted two-phase system with said fiber; while:
   a. raising the temperature of said two-phase system to a temperature sufficient to dye the fiber;
   b. maintaining a superatmospheric pressure on said system sufficient to maintain the liquids thereof substantially in the liquid state;
   c. circulating the two-phase system through the dyeing equipment and the expansion flash chamber communicating therewith;
   d. reducing the volume of solvent in said system by distilling the solvent from the system by releasing the pressure thereon in said flash chamber to vaporize said solvent and a portion of said water if it azeotropes with said solvent;
   e. recycling the water and any solvent which does not flash off to the dyeing equipment;
   f. continuing said circulation and said volume reduction while maintaining the volume of said system substantially constant by adding steam from a source external of the circulating water to the system; and
4. continuing said reduction of said solvent until the system is substantially free of solvent.

* * * * *

UNITED STATES PATENT AND TRADEMARK OFFICE

CERTIFICATE OF CORRECTION

PATENT NO. : 3,973,908

DATED : August 10, 1976

INVENTOR(S) : James L. Dunn, Jr.

It is certified that error appears in the above-identified patent and that said Letters Patent are hereby corrected as shown below:

On the Title Page, References Cited, the first reference should read -- Sertorio --, not "Lertorio"

On the Title Page, References Cited, the second reference should read -- Sieber --, not "Lober"

Cols. 5 and 6 in the Table, the fourth line of col. 1, delete "62-1969" and insert -- 61-1969 --

In the Table, fifth line, col. 6, insert -- 5 --

In the Table, tenth line, col. 1, delete "AATC" and insert -- AATCC --

Signed and Sealed this

Eighteenth Day of January 1977

[SEAL]

*Attest:*

RUTH C. MASON
*Attesting Officer*

C. MARSHALL DANN
*Commissioner of Patents and Trademarks*